US005308142A

United States Patent [19]

Forslund, III et al.

[11] Patent Number: 5,308,142

[45] Date of Patent: May 3, 1994

[54] CHAIR WITH ARM MOUNTED MOTION CONTROL

[75] Inventors: Carl V. Forslund, III, Grand Rapids; Frederick S. Faiks, Greenville; Thomas G. Feldpausch, Hastings, all of Mich.

[73] Assignee: Steelcase, Inc., Grand Rapids, Mich.

[21] Appl. No.: 824,571

[22] Filed: Jan. 23, 1992

[51] Int. Cl.[5] ..... A47C 1/02

[52] U.S. Cl. ..... 297/286; 297/288; 297/297

[58] Field of Search ..... 297/286–288, 297/297, 300, 359, 457, 285

[56] References Cited

U.S. PATENT DOCUMENTS

| | | | |
|---|---|---|---|
| D. 167,607 | 9/1952 | Becker . | |
| 144,719 | 5/1946 | King et al. . | |
| 145,595 | 12/1873 | Schastey | 297/359 X |
| 357,388 | 2/1887 | Hunzinger . | |
| 2,264,143 | 11/1941 | Scott et al. . | |
| 2,597,105 | 5/1952 | Julian . | |
| 2,690,793 | 10/1954 | Pederson et al. | 297/359 |
| 2,710,647 | 6/1955 | Dorton . | |
| 2,962,087 | 11/1960 | Barecki et al. | 297/359 X |
| 3,583,759 | 6/1971 | Kramer | 297/457 X |
| 3,589,772 | 6/1971 | Leaver . | |
| 3,743,352 | 7/1973 | Kallander . | |
| 3,874,727 | 4/1975 | Mehbert et al. . | |
| 3,917,341 | 11/1975 | Albinson . | |
| 4,131,315 | 12/1978 | Vogtherr . | |
| 4,451,085 | 5/1984 | Franck et al. . | |
| 4,502,729 | 3/1985 | Locher . | |
| 4,522,444 | 6/1985 | Pollock . | |
| 4,557,521 | 12/1985 | Lange | 297/285 |
| 4,790,596 | 12/1988 | Shifferaw . | |
| 4,819,986 | 4/1989 | Markus . | |
| 4,840,426 | 6/1989 | Vogtherr et al. . | |
| 4,880,273 | 11/1989 | Markus . | |
| 4,889,385 | 12/1989 | Chadwick et al. . | |
| 4,911,501 | 3/1990 | Decker et al. . | |
| 4,971,394 | 11/1990 | Vanderminden . | |
| 5,026,117 | 6/1991 | Faiks et al. . | |
| 5,042,876 | 8/1991 | Faiks . | |
| 5,046,780 | 9/1991 | Decker et al. . | |

FOREIGN PATENT DOCUMENTS

| | | | |
|---|---|---|---|
| 1285135 | 4/1969 | Fed. Rep. of Germany | 297/359 |

*Primary Examiner*—James R. Brittain

*Attorney, Agent, or Firm*—Price, Heneveld, Cooper, DeWit & Litton

[57] ABSTRACT

A chair is provided with a frame defining a curved arm support, a seat supported in the frame, and a back. An arm member is movably mounted on the arm support and operatively connected to the back so that movement of the back between upright and reclined positions is controlled by the arm member and arm support. A resilient spring is operatively connected to the back to bias the back towards an upright position. In one embodiment, the resilient spring encompasses the curved arm support and provides support for a seated user's arm. In another embodiment, an arm cap covers the resilient spring. Optionally, the arm cap slideably rides on roller bearings over the curved arm support. In another embodiment, the curved arm support and arm member are telescopingly arranged, and the resilient spring is operably placed therein. Another embodiment includes first and second springs, the second springs being disengageable to produce discrete selectable levels of bias force for biasing the back toward the upright position. In another embodiment, the resilient spring is continuously adjustable, and includes a control mechanism including opposing springs that slide on a pivotable actuator arms thus creating a variable torque arm which is adjustable to vary the resulting bias force on the chair back.

38 Claims, 8 Drawing Sheets

CHAIR WITH ARM MOUNTED MOTION CONTROL

BACKGROUND OF THE INVENTION

The present invention relates to chairs, and in particular to a chair having a mechanism to control chair back movement.

Chairs utilizing tiltable chair backs are commonly used to provide increased user comfort. However, the mechanisms for controlling the rearward movement of the chair back are often complex and expensive. Further, many control systems for backs are bulky and/or cannot be easily incorporated into existing designs Still further, the adjustment of the biasing force for supporting a person during rearward tilting of the back is difficult. Thus, manufacturers continue to search for new and different ways to control the position and orientation of the chair back, along with ways to control the biasing force for supporting a person as the person leans rearwardly on the chair back.

SUMMARY OF THE INVENTION

A chair is provided including a frame defining a curved arm support, a seat supported in the frame, and a back. An arm member mounted on the curved arm support is operably connected to the back and is guided thereby so that movement of the back between upright and reclined positions is controlled by the arm member and curved arm support. A resilient means biases the back toward the upright position.

The invention offers several advantages over known art. The chair back movement is directly controlled by the curved arm support which acts as a guide, and the particular position and orientation of the back can thus be directly controlled. Further, the seat orientation can also be readily controlled by attaching the seat to the chair frame and chair back. Further, the curved arm support which acts as the guide can be readily incorporated into the chair frame design. Still further, the various embodiments of the invention exhibit a trim profile and a high degree of flexibility of use such that they can be readily incorporated into existing styles Also, they are manufacturable at a low cost of materials and permit an uncomplicated assembly. Still further, they present a variety of unique modernistic appearances. Also, the invention is adaptable to accept a variety of different mechanisms that permit discrete and/or continuous adjustment of the biasing force on the chair back. Embodiments include an arm mounted discretely engageable mechanism for engaging/disengaging support for the chair back, and also include a continuously adjustable mechanism for varying the biasing force on the chair back. Further, these mechanisms can be made mechanically additive in parallel or in series. Thus, the present invention offers a high degree of design flexibility, is economical to manufacture, and is capable of along service life.

These and other features, advantages and objects of the present invention will be further understood an appreciated by those skilled in the art by reference to the following specification, claims and appended drawings.

BRIEF DESCRIPTION OF THE DRAWINGS

FIG. 1 a fragmentary perspective view of the arm support in FIG. 8, but with the release mechanism engaged and the chair back in a reclined position;

DESCRIPTION OF THE PREFERRED EMBODIMENTS

Figure 1:
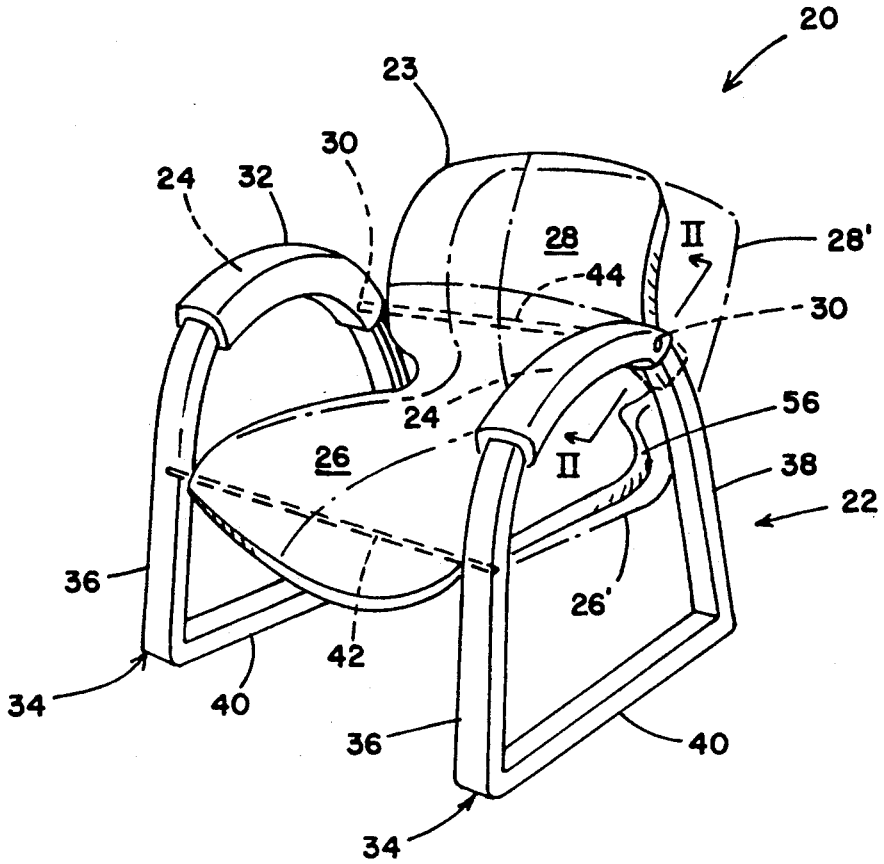
FIG. 1 is a perspective view of a chair embodying the present invention.

The reference numeral 20 (FIG. 1) generally designates a first embodiment of a chair embodying the present invention. Chair 20 includes a frame 22 defining a pair of curved arm supports 24, and a chair shell 23. Shell 23 includes a seat 26 movably supported in frame 22 and a back 28 operably connected to seat 26 and to frame 22. Arm members 30 extending laterally from the sides of chair back 28 are movably guidably mounted on each curved arm support 24 and operably connected to either side of back 28. Movement of back 28 between upright and reclined positions is controlled by arm members 30 and arm supports 24. Resilient springs 32 each attached at a forward end to curved arm support 24 and at a rearward end to an arm member 30 resiliently bias back 28 toward the upright position as back 28 is tilted rearwardly.

Figure 2:
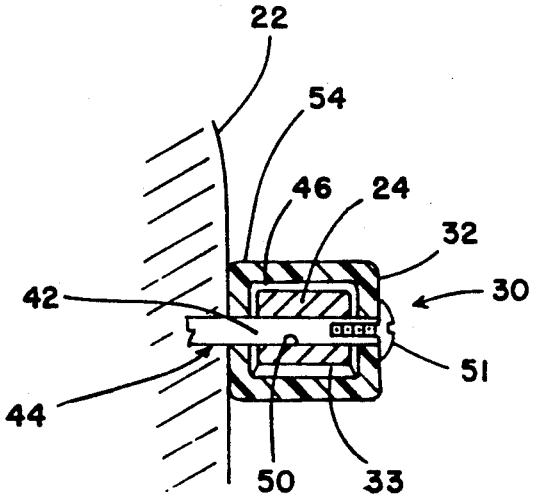
FIG. 2 is a section taken along plane II—II in FIG. 1.
Figure 2A:
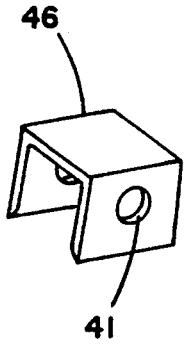
FIG. 2A is a perspective view of a component in FIG. 1.

Frame 22 (FIG. 1) includes a pair of side subframes 34 located on either side of seat 26. Each subframe 34 includes a forward leg 36 and a rearward leg 38 interconnected at their upper ends by curved arm support 24. Curved arm support 24 defines a slot 50 (FIG. 2) at the rearward end thereof. Legs 36 and 38 are stabilized a their lower ends by a cross brace 40. Subframes 34 extend generally upwardly in parallel planes on either side of and adjacent seat 26. Seat 26 is pivotally mounted at a forward end to legs 36 by a pivot rod 42. Pivot rod 42 extends laterally through an outer forward portion of seat 26 into an upper portion of legs 36. Rod 42 is secured to legs 36 in a manner that adds stability to subframes 34 to form frame 22, but permits seat 26 to rotate thereon.

Figure 3:
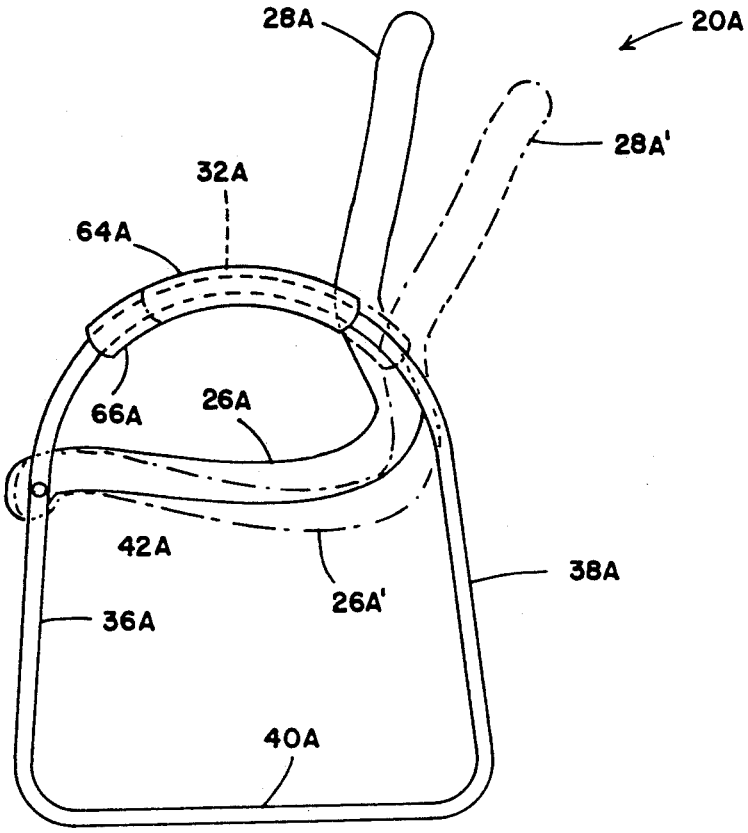
FIG. 3 is a side view of a second embodiment of a chair embodying the present invention.

Arm members 30 (FIG. 2) pivotally and movably mount chair back 28 to curved arm supports 24. Each arm member 30 includes an inverted U-shaped bearing sleeve 46 (FIG. 3) slideably mounted on arm support 24. Sleeve 46 includes a hole 47 in each of its sides adjacent slot 50.

A pivot rod 44 (FIGS. 1 and 2) extends laterally from the sides of back 28 and includes ends 48 that extend through holes 47 in sleeve 46 into slot 50 in arm supports 24. Rod ends 48 are slideably secured in holes 47 and slot 50 such as by a headed bolt 51. Sleeve 46 is a stiff material that acts to distribute the stress generated between spring 32 and rod end 48 in a manner compatible with the long term service life of spring 32. In the embodiment shown, sleeve 46 is preferably made of a stiff plastic material such as nylon or the like. However, it is contemplated that a number of different bearing arrangements are possible. Sleeve 46 guides chair back 28 on curved arm support 24 as chair back 28 moves between upright and reclined positions.

Spring 32 (FIGS. 1 and 2) is an elastomeric-like material in the shape of a tube, and is telescopingly slipped over bearing sleeve 46 and onto leg 36 or 38 into place on curved arm support 24. The rearward end of spring 32 is secured to sleeve 46 by an adhesive or other suitable fastener. The front end of spring 32 is then secured to the forward end of curved arm support 24 by adhesive and/or a mechanical attachment. Since spring 32 is located on the outside of arm support 24, the upper outer surface 54 of spring 32 forms an armrest for the forearm of a person seated in chair 20. The inner diameter of spring 32 is large enough to leave a gap 33 between it and arm support 24 so that as spring 32 stretches, the inner diameter does not reduce to a size that binds on curved arm support 24. Lubricants (not shown) are added as necessary to promote slippage of spring 32 on curved arm support 24 in locations forward of bearing sleeve 46.

Figure 16:
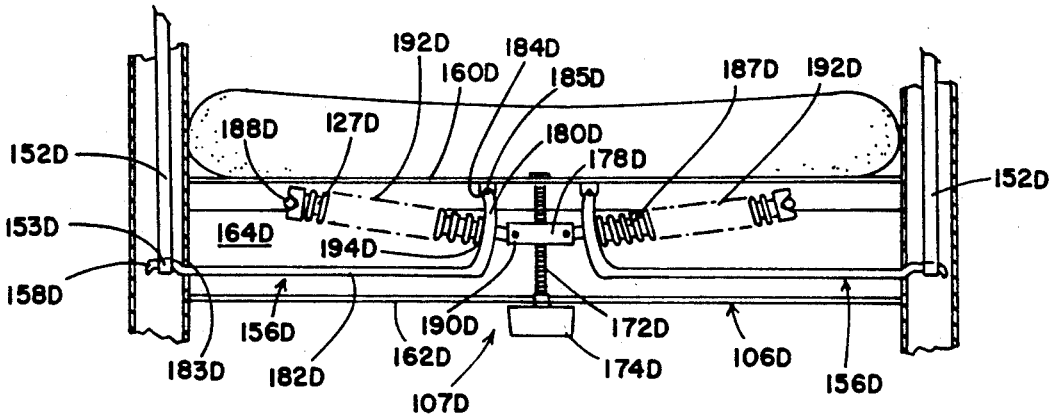
FIG. 16 is an enlarged fragmentary front view of the chair in FIG. 14 with the front of the front cross brace removed.

Chair shell 23 as shown is an upholstered one-piece structure with seat 26 and back 28 interconnected by a resilient but flexible intermediate or lower lumbar portion 56. Shell 23 is strong enough to join with frame 22 to form a stable assembly. As can be seen, as a person leans rearwardly in chair 20, seat 26 tilts rearwardly and downwardly about rod 42 as back 28 moves and rotates rearwardly. The rearwardly titled position of the chair seat and back is shown in phantom and designated as 26' and 28', respectively. Notably, the resiliency of lower lumbar portion 56 compliments springs 32 in supporting back 28, such as by providing a static preload force or dynamic biasing force as back 28 is reclined. In the embodiment shown, arm support 24 permits back 28 to rotate at a greater angle than seat 26 as the seated user leans rearwardly, thus providing an ergonomical rearward movement. Alternatively, rod 42 could be replaced with a cross brace that fixedly attaches chair seat 26 to frame 22, or which slideably attaches seat 26 to frame 22. For example, a sliding arrangement would be desirable to permit seat 26 to move horizontally with respect to frame 22 but not vertically so that a seated user does not experience upward pressure under their legs when reclining. An exemplary cross brace arrangement is shown in FIG. 16 with cross brace 106D.

Though only a unitary shell 23 is shown, it is contemplated that a separate chair back not directly connected to the chair seat could also be constructed. In such case, the arm members 30 would include an elongated bearing sleeve or bracket (not shown) that is long enough to stably support the separate chair back on curved arm supports 24. It is also contemplated that the invention includes a variety of different designs such as replacing rod 44 and sleeve 46 with a sliding bracket (not shown) attached to the side of chair back 28.

Figure 4:
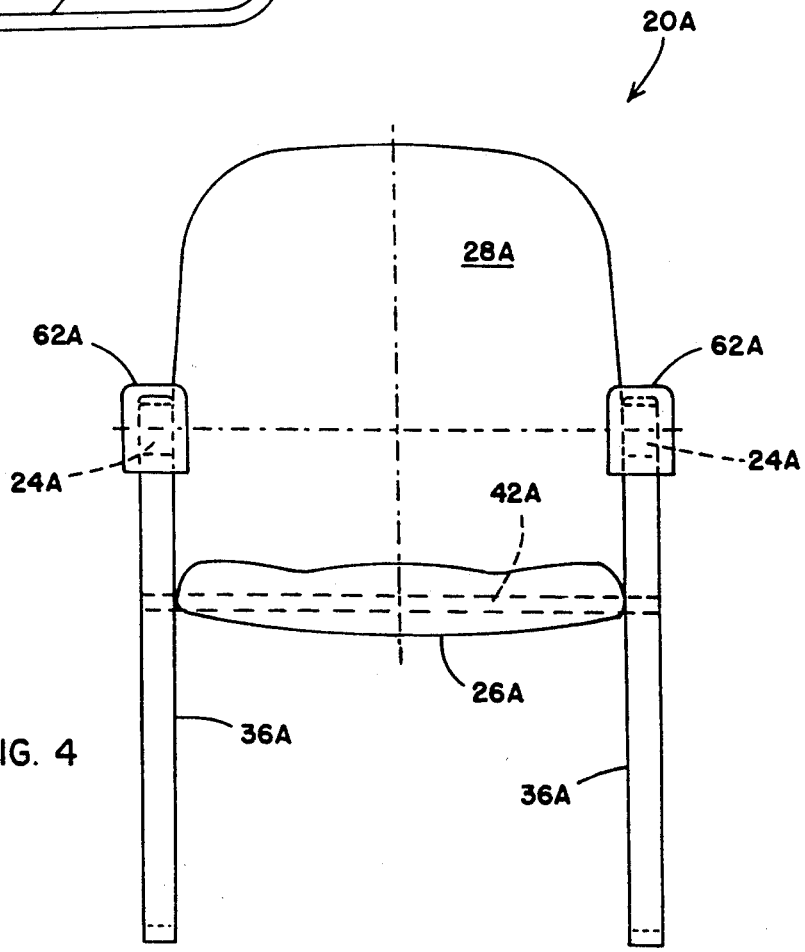
FIG. 4 is a front view of the chair in FIG. 3.

Chair 20A (FIGS. 3–5) also embodies the present invention. To reduce repetition in the description herein, components of chair 20A that are similar to chair 20 are labelled with similar numbers but with an alphabetical letter "A" being added thereto. Further embodiments will also be similarly designated, but with subsequent alphabetical letters "B", "C", and "D".

Chair 20A includes an extensible elastic spring 32A operably mounted on curved arm support 24A similar to chair 20, but in chair 20A, spring 32A is covered by an arm cap or trim cover 62A and is not directly exposed. Thus, arm cap 62A provides the surface for supporting a person's arm when seated in chair 20A, and not spring 32A.

Figure 5:
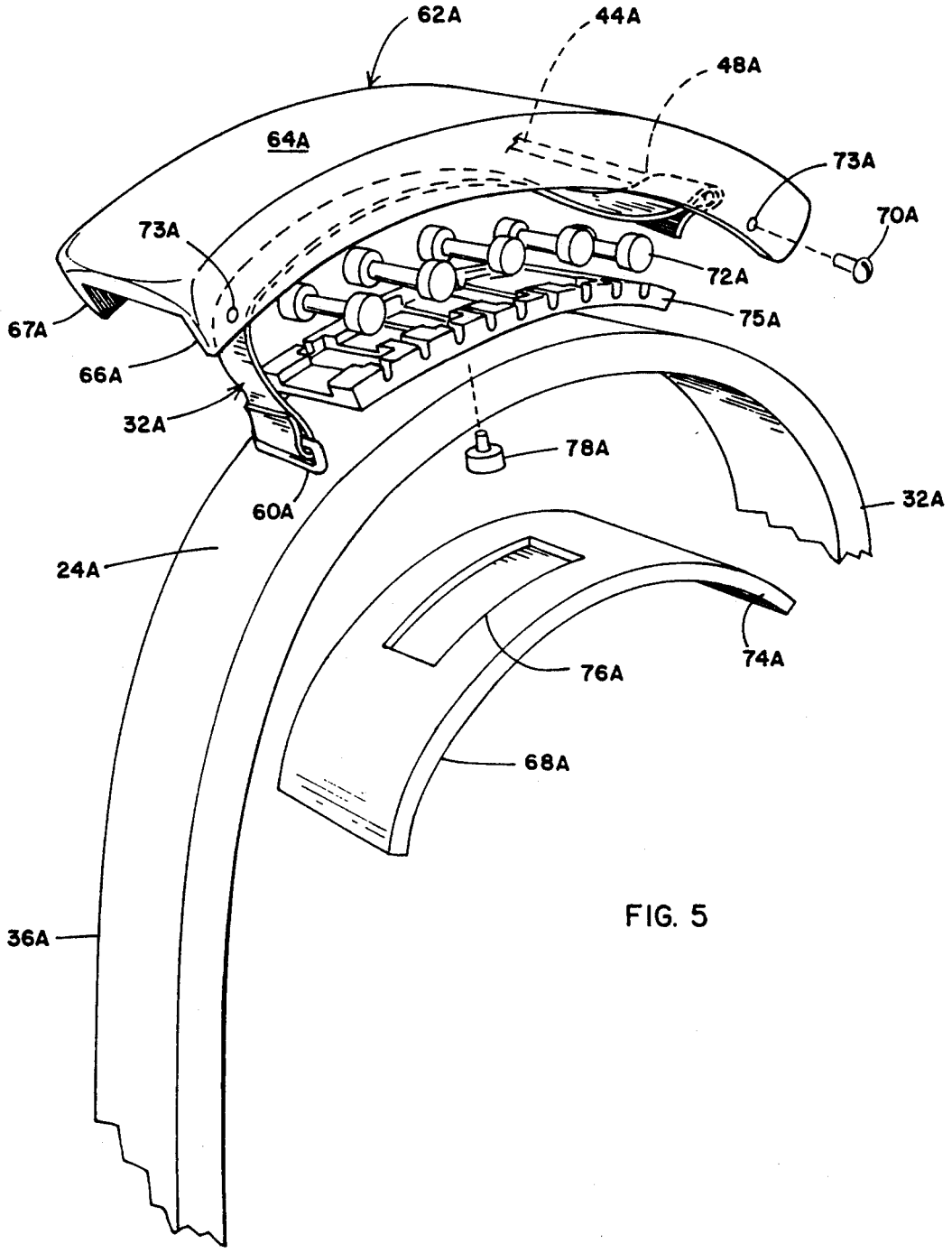
FIG. 5 is an exploded perspective view of the arm support shown in FIG. 3.

As shown in FIG. 5, spring 32A is attached to curved arm support 24A at a forward end by attachment loop 60A and at a rearward end to chair back 28A around rod end 48A of rod 44A. Arm cap or trim piece 62A has an inverted U-shape with a top smoothly curved portion 64A and downwardly draping side portions 66A and 67A. Side portions 66A and 67A extend below curved arm support 24A and attach to a lower trim piece 68A at forward and rearward positions by bolts such as bolts 70A that extend through holes 73A in side portions 66A and 67A of arm cap 62A and holes 74A in trim piece 68A. When assembled, arm cap 62A and trim piece 68A fully surround arm support 24A and are guided therealong as chair back 28 is moved.

To reduce resistance to movement, roller bearings 72A are placed in a bearing retainer 75A, the subassembly being mounted under spring 32A and between spring 32A and arm support 24A. Bearings 72A facilitate the sliding motion of arm cap 62A as spring 32A is extended, reducing the need for messy lubricants and the like.

Trim piece 68A optimally includes a slot or notch 76A which receives a downwardly extending stud 78A secured to the underside of arm support 24A. As stud 78A engage the ends of notch 76A, it limits the travel of back 28A along arm support 24A, thus determining the upright and reclined positions of back 28A. Further, the position of the upright and reclined positions can be varied to a particular user's preference by relocating stud 78A on curved arm support 24A. It is also contemplated that the length of notch 76A could also be varied so as to change the length of angular travel of chair back 28A. This could be done, for example, by adding spacers in notch 76A. Adjustment of stud 78A or changing the length of notch 76A also changes the preload on spring 32A.

Figure 6:
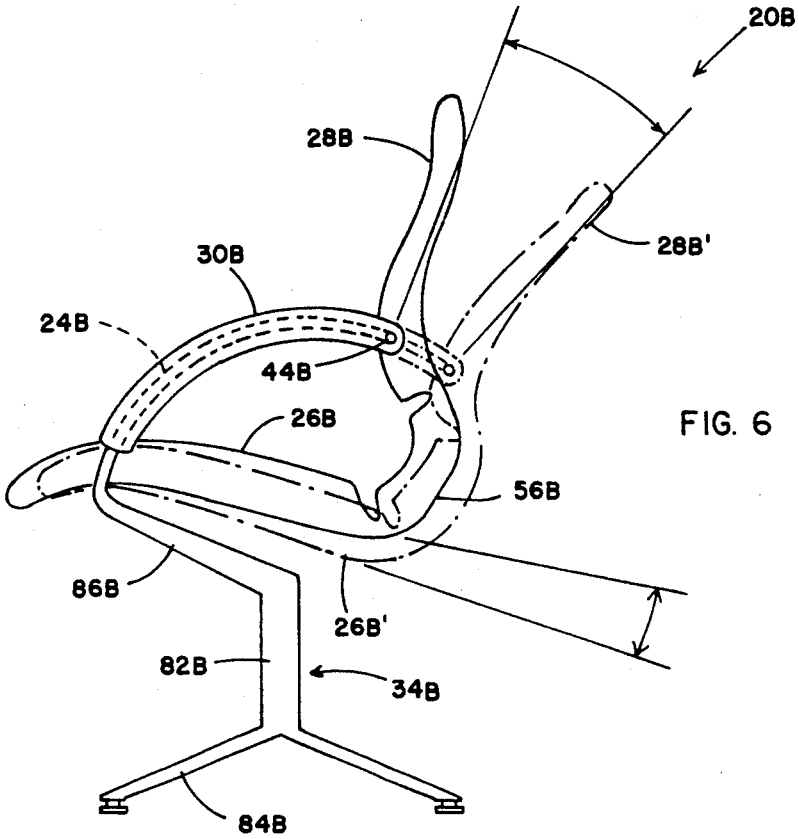
FIG. 6 is a side view of a third embodiment of a chair embodying the invention.
Figure 7:
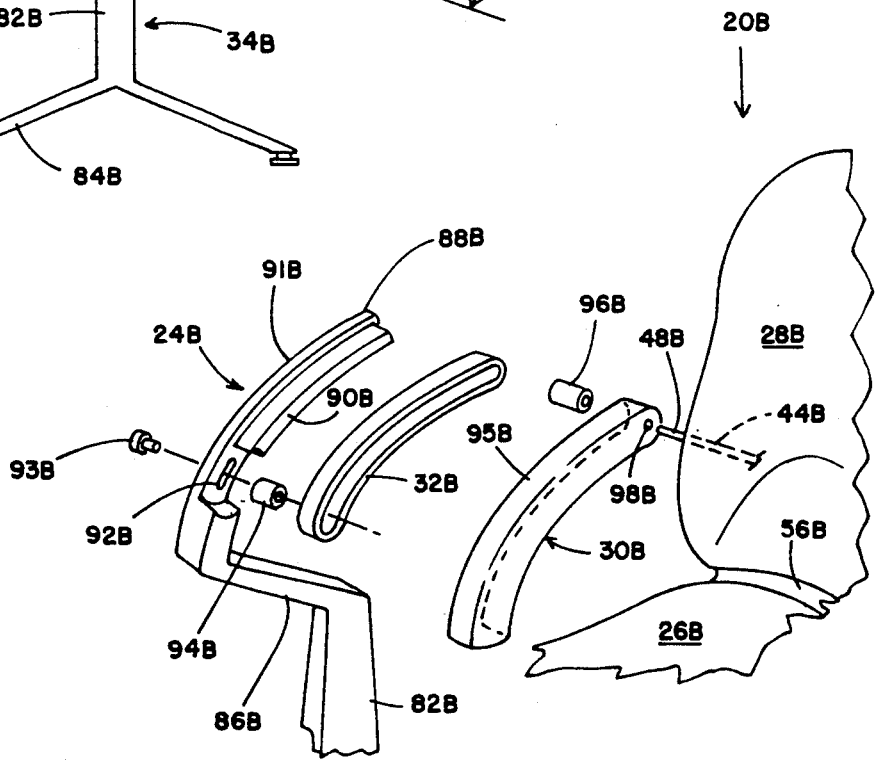
FIG. 7 is an exploded perspective view of the arm support shown in FIG. 6.

Another embodiment, shown in FIGS. 6 and 7 is designated by the numeral 20B. Chain 20B includes a subframe 34B having a post 82B connected at a lower end to laterally extending supports 84B, and at an upper end to laterally extending upper portion 86B. Portion 86B is in turn connected to the front of curved arm support 24B. In chair 20B (FIG. 7), arm support 24B has a free end 88B that extends arcuately and rearwardly from the forward end of seat 26B. Arm support 24B includes a laterally extending inwardly facing arcuate rib 90B and a side edge 91B along a portion of its length. At the forward end of rib 90B is an elongated slot 92B adapted to receive a dowel, plug or stud 94B for holding one end of spring 32B. A retaining bolt 93B holds dowel 94B in place. Retaining bolt 93B includes a threaded shaft that extends through slot 92B into dowel 94B. Retaining bolt 93B is tightenable to hold dowel 94B at various locations along slot 92B so as to vary the tension on or preload of spring 32B.

Arm member 30B has a curved shape that corresponds to rib 90B on arm support 24B, and a C-shaped section with ledges 95B that face outwardly overlayingly about rib 90B and engagingly against side edge 91B. Arm member 30B slideably and telescopingly engages arm support 24B about rib 90B. Arm member 30B is attached to back 28B by a dowel or plug 96B that securely engages the outer end 48B of rod 44B as outer rod end 48A extends through hole 98B in arm member 30B. As assembled, when back 28B is in the upright position, plug 96B is adjacent the rear end of rib 90B and in substantial alignment with rib 90B. An elastomeric spring 32B in the shape of a continuous rubber-band stretches between plug 96B and dowel 94B around rib 90B and inside of C-shaped section ledges 95B. As back 28B is moved rearwardly, arm member 30B slides about arm support 24B, and spring 32B is elastically extended resiliently biasing chair back 28B toward the upright position.

Figure 8:
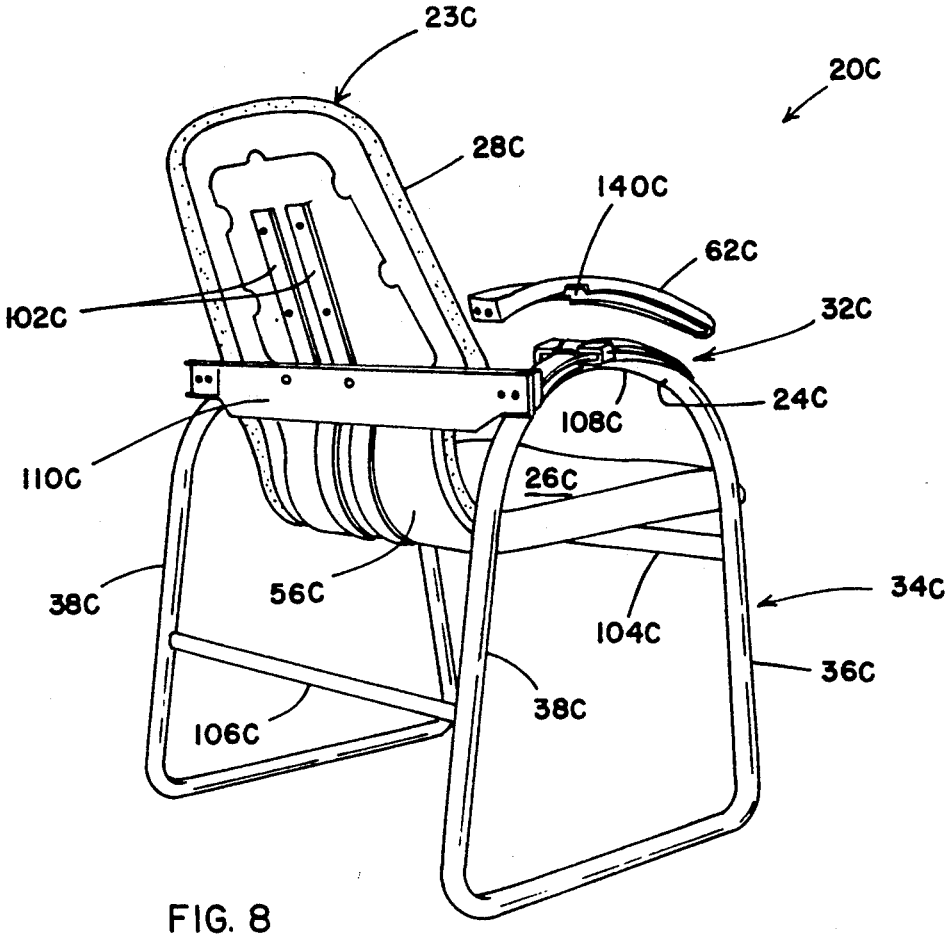
FIG. 8 is a rear perspective view of a fourth embodiment of a chair embodying the present invention with a trim cover exploded away.

Chair 20C (FIG. 8) is another embodiment and is unique in that it includes a tri-level or "segmented" energy system wherein the level of energy can be selectively set at discrete predetermined levels of support for the chair back 28C. Chair 20C includes bent leaf springs 102C that are operably attached to shell 23C on the bottom of seat 26C and the back side of back 28C. Leaf springs 102C provide the first "level" of energy support. Chair 20C also includes springs 32C on each arm support 24C, and a release mechanism 108C for selectively engaging/disengaging each arm spring 32C. Specifically, chair back 28C can be tilted rearwardly against the biasing force of only leaf springs 102C and shell 23C when the release mechanism 108C is disengaged on both springs 32C, or allows the biasing force to be increased by engagement of one or both arm springs 32C. Optimally, subframes 34C are rigidly interconnected to prevent twisting of frame 22C when only one spring 32C is engaged, such as by including cross braces 104C and 106C at a front and rear thereof, respectively.

Figure 9:
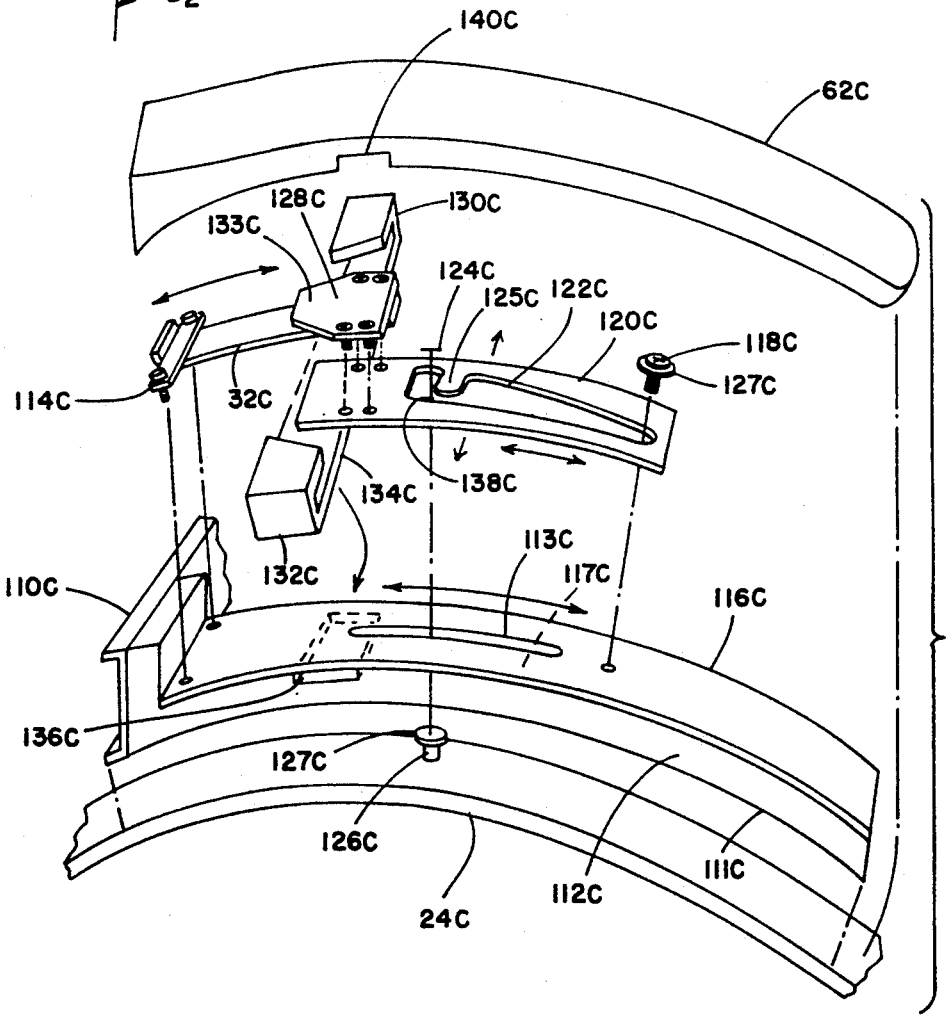
FIG. 9 is an exploded fragmentary perspective view of the arm support shown in FIG. 8.

Arm member 30C (FIG. 8) includes a cross bar 110C attached to back 28C that extends out over arm support 24C. A curved sliding bearing plate 112C (FIG. 9) securely attaches to the ends of cross bar 110C. A clasp 114C securely attaches one end of elastomeric spring 32C to plate 112C. A steel reinforcement plate 116C extends over first bearing plate 112C to reinforce same and prevent distortion thereof when spring 32C is forcibly extended. Optimally, bearing plate 112C includes side edges 111C that drape downwardly at least partially over the sides of curved arm support 24C so as to assure the aligned and smooth movement of plate 112C on arm support 24C. Reinforcement plate 116C and bearing plate 112C include aligned slots 113C and 117C, respectfully. An anchor or ground pin 126C with a head 127C extends upwardly through slots 113C and 117C. Anchor pin 126C is fixedly secured to arm support 24C. An elongated engagement plate 120C lies on and is pivotally held against reinforcement plate 116C by an anchor pin 118C. In the embodiment shown, anchor pin 118C is secured to bearing plate 112C and reinforcement plate 116C (and not to arm support 24C), though other arrangements are contemplated.

Elongated engagement plate 120C includes an elongate but triangular slot 122C with notch 124C formed by a tab 125C at a rearward end. Anchor pin 118C, which extends through slot 122C includes a washered head 127C that engages the top of the marginal edge around slot 122C. Pin 118C holds engagement plate 120C to reinforcement plate 116C. Tab 125C is adapted to engage or disengage ground pin 126C. As engagement plate 116C is pivoted on anchor pin 118C, tab 125C forms a hook and catch arrangement with ground pin 126C. The head 127C of ground pin 126C rides on the top of engagement plate 120C around the marginal edge of slot 122C holding plates 120C, 116C, and 112C against support arm 24C. A clasp 128C for retaining the second end of spring 32C is at the rearward end of elongated engagement plate 120C. Engage and disengage buttons 130C and 132C are located on either side of clasp 128C adjacent a bumper 133C on engagement plate 120C. Buttons 130C and 132C are interconnected by a slideable web 134C that slideably moves within a channel 136C in bearing plate 112C but under reinforcement plate 116C. Buttons 130C and 132C can be pushed to cause elongate engagement plate 120C to pivot about anchor pin 118C. This causes notch 124C to engage and disengage, respectively, from ground pin 126C, as discussed below. Tab 125C includes a tip 138C that causes tab 125C to positively frictionally engage anchor pin 126C as engagement plate 120C is pivoted between engage and disengage positions.

Figure 11:
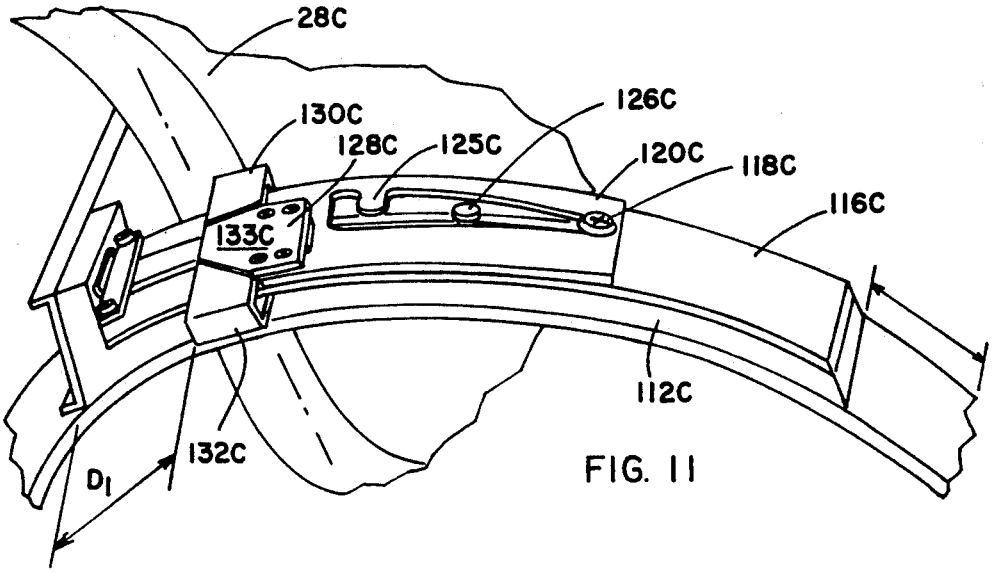
FIG. 11 is a fragmentary perspective view of the arm support in FIG. 8, but with the release mechanism disengaged and the chair back in a reclined position.
Figure 10:
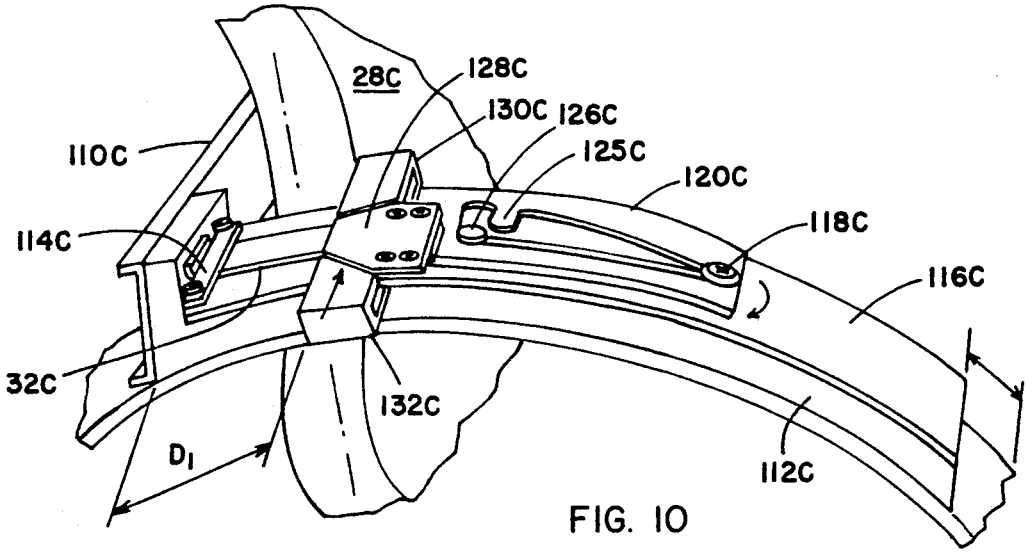
FIG. 10 is a fragmentary perspective view of the arm support in FIG. 8, but with the trim cover removed, the release mechanism in a disengaged position and the chair back in an upright position.

In operation, chair 20C is used as follows. With disengage button 132C depressed, engagement plate 120C pivotally moves on anchor pin 118C to a disengaged position and tab 125C disengages from anchor pin 126C (FIG. 10). In this disengaged position, as a seated user leans rearwardly, chair back 28C is only supported by leaf springs 102C. Spring 32C is not extended or stretched as chair back 28C moves rearwardly, since anchor pin 126C slides harmlessly past tab 125C along slot 122C in engagement plate 120C (FIGS. 10 and 11). All of plates 120C, 116C, and 112C slide rearwardly in unison with cross bar 110C and chair back 28C to the rearward reclined position. This is most evident by noticing the constant dimension $D_1$ between cross bar 110C (i.e. clasp 114C, and clasp 128C. Spring 32C thus provides a first level of support. Significantly, spring 32C can include a unique static preload force for providing an initial level of support before back 28C begins to recline, and also can include a unique dynamic biasing force profile as back 28C is reclined.

Figure 13:
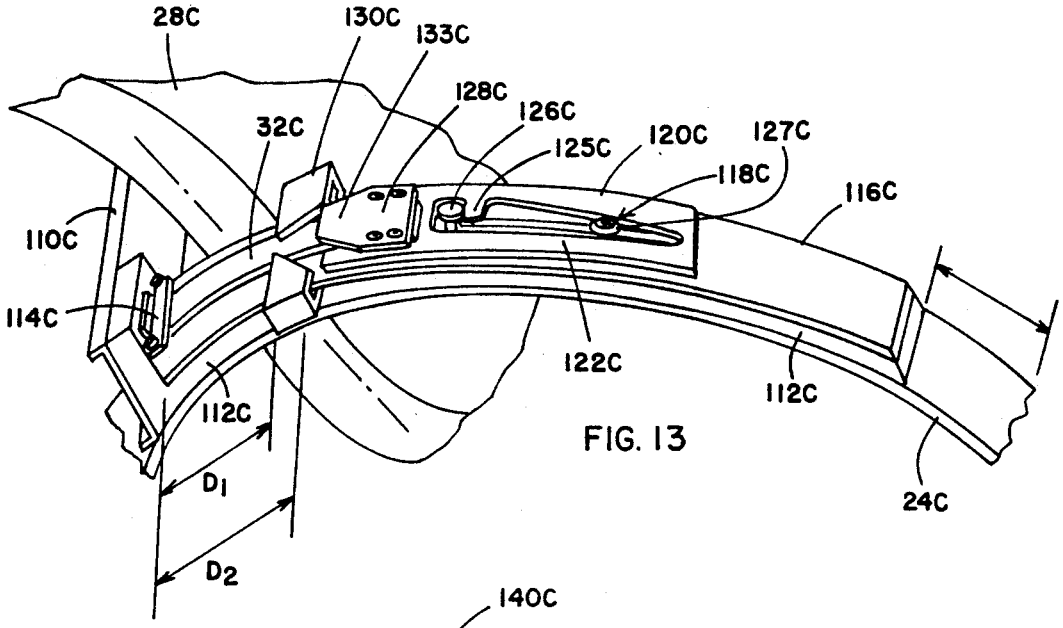
Figure 12:
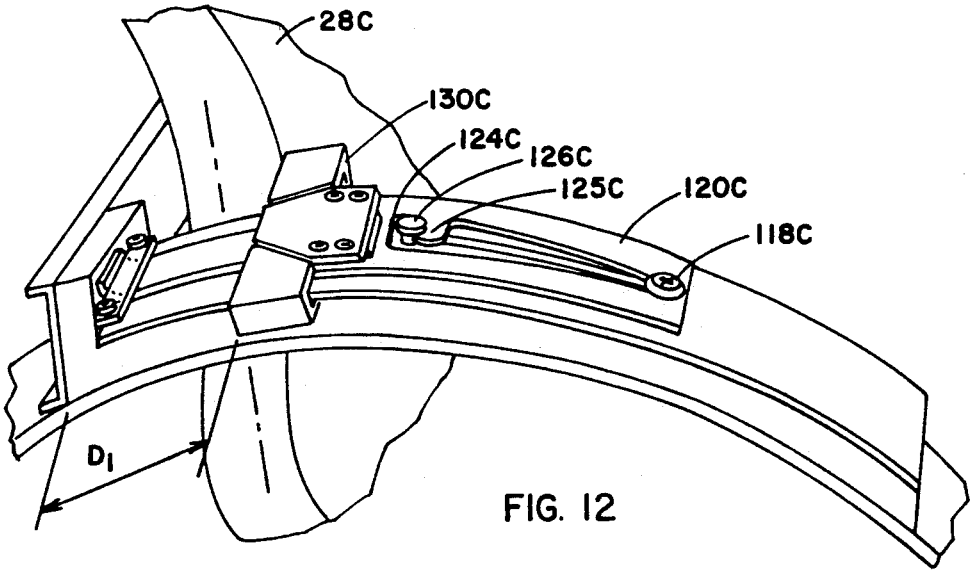
FIG. 12 is a fragmentary perspective view of the arm support in FIG. 8, but with the release mechanism engaged and the chair back in an upright position.

Alternatively, with back 28C in the upright position, engage button 130C is depressed so that engagement plate 120C pivotally moves on anchor pin 118C to an engaged position and anchor pin 126C slips into notch 124C and into engagement with tab 125C (FIG. 12). As a seated used leans rearwardly, anchor pin 126C prevents the movement of engagement plate 120C (FIG. 13). However, bearing plate 112C and reinforcement plate 116C move rearwardly as chair back 28C and specifically cross bar 110C force them rearwardly. Thus, spring 32C is stretched as the distance between clasp 114C on bearing plate 112C and clasp 128C on engagement plate 120C increases from "$D_1$" to "$D_2$". Notably, anchor pin 118C slides within slot 122C toward anchor pin 126C. However, slot 122C is triangularly-shaped so that washered head 127C of anchor pin 118C continues to engage the marginal edge of slot 122C. In the reclined position (FIG. 13), spring 32C is stretched and cumulatively adds to the biasing force of leaf springs 102C and chair shell 23C causing back 28C to be biased forwardly with a greater force.

Thus, it can be seen that discrete levels of biasing force are selectively set by engagement of one or both arm springs 32C. Optimally cross braces 104C, 106C, and cross bar 110C provide a non-twisting frame that does not adversely twist should only one arm spring 32C be engaged. A unique feature of the embodiment shown is that buttons 130C and 132C are drawn away from clasp 128C and bumper 133C such that they are inoperative when spring 32C is engaged and stretched (i.e. chair 20C is in a reclined position) (FIG. 13). Thus, a user cannot accidentally disengage spring 32C and suddenly release the cumulative dynamic biasing force on chair back 28C when spring 32C is stretched.

An arm cap or trim cover 62C (FIG. 9) is secured over release mechanism 108C and sliding bearing plate 112C to improve aesthetics and functionally prevent interference with the operation of engagement plate 120C. Arm cap 62C is secured such as by screws or other fastening means to bearing plate 112C, and includes apertures 140C for receiving or permitting access to buttons 130C and 132C.

Figure 14:
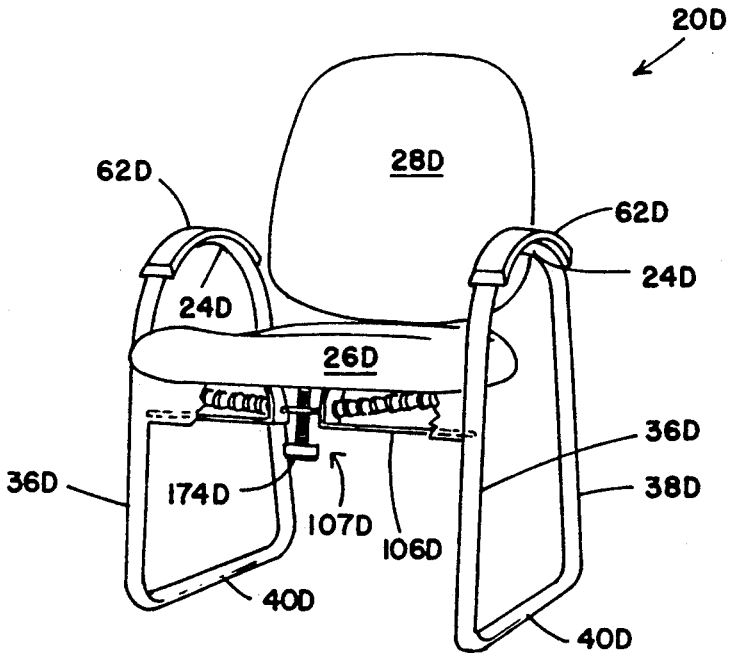
FIG. 14 is a front perspective view of a fifth embodiment of a chair embodying the present invention with the front cross bar partially broken-away to expose the torque mechanism.
Figure 15:
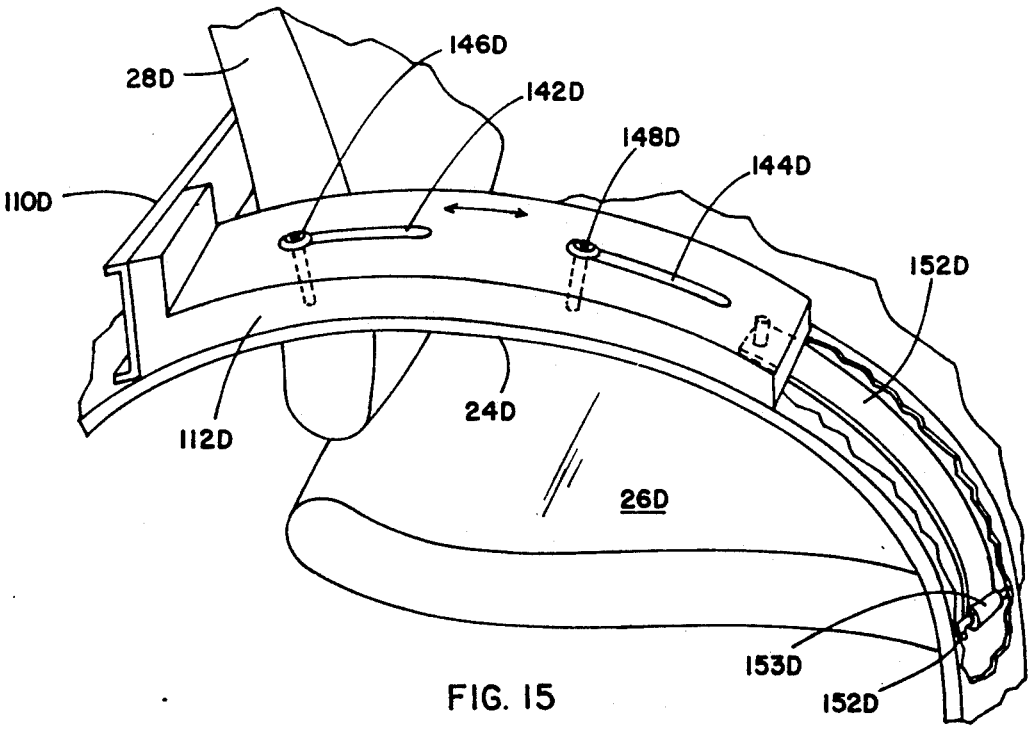
FIG. 15 is an enlarged fragmentary perspective view of the curved arm support in FIG. 14 partially broken-away.

Chair 20D (FIG. 14) is another embodiment and is unique in that it provides a continuous adjustable torque control mechanism 107D. Mechanism 107D is in a convenient location for adjustment near the front and below chair seat 26D. It is also convenient in that it is quickly adjustable with minimal effort. Chair 20D (FIG. 15) includes a slideable bearing plate 112D. Plate 112D includes slots 142D and 144D with headed bolts 146D and 148D extending therethrough into curved arm support 24D. Headed bolts 146D and 148D engage the top of the marginal edge around slots 142D and 144D, respectively, so that bearing plate 112D is guided on arm support 24D. The rear of biasing plate 112D is secured to the ends of cross bar 110D which is secured to and moves rearwardly in unison with chair back 28D. A strap 152D is secured to the forward end of bearing plate 112D and extends forwardly within tubular curved arm support 24D. In the embodiment shown, strap 152D is a flexible but non-elastic band secured to an L-shaped bracket 156D (FIG. 16) on a free end 158D thereof at forward looped strap end 153D. However, it is contemplated that strap 152D could be a spring or a strap made of elastomeric material with L-shaped bracket 156D being adjustable to vary the tension in spring 32D. An arm cap or trim cover 62D attaches over bearing plate 112D to provide an aesthetic appearance.

Forward cross brace 106D (FIG. 16) is a rectangular tubular member that extends between an upper part of forward legs 36D and houses torque control mechanism 107D for adjustably varying the force on strap 152D. Forward cross brace 106D includes an upper wall 160D, lower wall 162D, and sides 164D with the terminal lateral ends of cross brace 106D securely attaching to legs 36D. A threaded shaft 172D having course threads thereon is rotatably mounted through lower wall 162D and upper wall 160D at a central location therein. A handle or knob 174D is secured to the lower end of shaft 172D outside of and below lower wall 162D so that handle 174D is readily accessible.

L-shaped brackets or actuator arms 156D are pivotally mounted in cross brace 106D. Actuator arms 156D each include an inner short leg 180D and a long leg 182D. Inner short leg 180D is arcuate, and is pivotally mounted at a terminal end 184D to upper wall 160D, thus defining an axis of rotation 185D. Long legs 182D extend outwardly substantially parallel the length of cross brace 106D. Long legs 182D include a free end 158D that extends into the tubular diameter of chair legs 36D through slots 183D in legs 36D to connect to strap 152D. In the embodiment shown, free ends 158D extend into the looped end 153D in strap 152D, though alternative connections are contemplated.

A pair of internal guide bars 187D are operably mounted on either side of shaft 172D within coil springs 192D. Each guide bar 186D is pivotally mounted at one end 188D to cross brace 106D a distance spaced from short leg 180D and pivotally connected at the other end 190D to a side of an enlarged nut 178D. A coil spring 192D is mounted around each guide bar 186D so that coil spring 192D extends between and is compressed between end 188D and short leg 180D, the inner end 194D of coil spring 192D resting slideably against the outer lateral surface of short leg 180D. As shaft 172D is rotated, nut 178D is moved causing guide bar 187D to pivot about end 188D so that inner end 194D of coil spring 192D slideably moves on short leg 180D. Since actuator arm 156D pivots about axis 185D, the movement of spring 192D along short leg 180D changes the torque arm that spring 192D is acting on. This in turn causes a corresponding change in biasing force at the outer end of long leg 182D, as expressed by the well-known engineering equation $F_1D_1=F_2D_2$. In the embodiment shown, in this equation, $F_1$ equals the biasing force of compressed spring 192D, $D_1$ equals the moment arm from axis 185D to a central point on short leg 180D adjacent end 194D of coil spring 192D, $D_2$ equals the distance from axis 185D to looped strap end 153D, and $F_2$ equals the resulting biasing force on strap 152D for resisting rearward movement of chair back 28D.

In operation, the forward biasing force on chair 20D is adjusted by rotating handle 174D and shaft 172D. This causes nut 174D to move which in turn causes the inner end 194D of coil spring 192D to slide to a desired position and a desired torque is created on short leg 180D about end 184D and in turn on actuator arm 156D. Hence, strap 152D and chair back 28D are biased forwardly with the desired biasing force. Notably, the biasing force is continuously adjustable, and is readily adjustable due to course threads on shaft 172D. As a seated user leans rearwardly forcing chair back 28D rearwardly, actuator arm 156D is forcibly rotated causing coil springs 192D to compress further. The arcuate movement of chair back 28D can be limited by bolts 146D, 148D in slots 142D, 144D in curved arm support 24D (FIG. 15), or can be limited by the movement of L-bracket 156D in slot 183D or the maximum stroke of coil springs 192D.

In the foregoing description, it will be readily appreciated by those skilled in the art that modifications may be made to the invention without departing from the concepts disclosed herein. Such modifications are to be considered as included in the following claims, unless there claims by their language expressly state otherwise.

The embodiments of the invention in which an exclusive property or privilege is claimed are defined as follows.

1. A chair comprising:

a frame defining a curved arm support;

a seat supported on said frame;

a back;

an arm member movably mounted on said curved arm support, said arm member being operatively connected to said back and guided by said curved arm support so that movement of said back from an upright position to a reclined position is controlled by said arm member and said curved arm support; and resilient means operatively connected to said back for resiliently biasing said back towards said upright position, said resilient means providing a static preload force and a dynamic biasing force on said back when reclined, and including release means for selectively changing one of said static preload force and said dynamic biasing force of said resilient means as said back is reclined.

2. A chair as defined by claim 1 wherein said resilient means comprises:

a spring having an end operably connected to said arm member; and connecting means attached to another end of said spring for connecting said another end to said arm support.

3. A chair as defined by claim 2 wherein said spring includes an elastic band of polymeric material.

4. A chair as defined by claim 1 wherein said seat is movably connected to said frame at a first connection and said seat and back are operably interconnected at a second connection whereby said arm member and arm support in cooperation with said frame control the movement of said seat as said back is moved.

5. A chair as defined by claim 1 including an arm cap with an upper support surface for supporting a person's arm thereon, and wherein said resilient means is covered at least in part by said arm cap.

6. A chair as defined by claim 1 including a shell forming said seat and back, said shell including an intermediate portion connecting said seat and back, said intermediate portion being flexible so as to permit relative movement between said back and said seat.

7. A chair as defined by claim 1 wherein said seat is movably supported in said frame and said resilient means is operatively connected to said seat.

8. A chair as defined by claim 7 wherein said resilient means includes leaf springs operably mounted to said seat and said back.

9. A chair as defined by claim 1 wherein said resilient means includes first and second resilient means, said second resilient means being operably attached to said release means.

10. A chair as defined by claim 9 wherein said release means includes a hook and catch arrangement with one of said hook and said catch being associated with said second resilient means and the other of said hook and said catch being associated with said frame, said hook and said catch being engageable to operatively engage said second resilient means and being disengageable to operatively disengage said second resilient means.

11. A chair as defined by claim 10 wherein said second resilient means includes a spring operatively mounted to said curved arm support and operatively interconnected between said back and said frame, and said release means disconnects said spring from one of said back and said frame.

12. A chair as defined by claim 1 wherein said resilient means is preloaded to provide an initial level of support before said back begins to recline.

13. A chair as defined by claim 1 wherein said resilient means includes a spring, and further includes an actuator arm operably connected to said frame an said spring, said spring biasing said actuator arm in a given direction.

14. A chair as defined by claim 13 wherein said actuator arm pivots on said frame defining as axis of rotation, and said spring creates a torque on said actuator arm about said axis.

15. A chair as defined by claim 14 including means for adjusting the biasing force of said resilient means on said back.

16. A chair as defined by claim 15 wherein said spring and actuator arm define a torque arm on said actuator arm about said axis, and said means for adjusting the tension on said actuator arm includes means for moving one of said spring and said actuator arm to change said torque arm on said actuator arm, hence changing the biasing force on said back.

17. A chair as defined by claim 16 including a threaded shaft and nut operably connected to said spring for slideably moving said spring relative to said actuator arm.

18. A chair as defined by claim 13 wherein said resilient means includes a pair of said springs and actuator arms each respective pair defining a torque arm, and said springs are slideable relative to said actuator arm so as to vary said torque arm on said actuator arm, thereby changing the biasing force on said back.

19. A chair as defined by claim 1 wherein said resilient means includes a spring located remote from said back and said curved arm support, and a strap operably connecting said spring to said chair back.

20. A chair as defined by claim 19 wherein said frame includes a cross brace, and said spring is located in said cross brace.

21. A chair as defined by claim 20 wherein said resilient means includes a actuator arm operably connected to said strap, and said spring is operably connected to said actuator arm and frame to bias said actuator arm and in turn said strap in a given desired direction.

22. A chair comprising:

a frame including armrests;

a seat supported on said frame;

a tiltable movably supported on said frame and movable between upright and reclined positions;

a control mechanism including guide means located on said armrests for directing the path of movement of said back during movement between said upright and reclined positions, and further including resilient means for biasing said back towards said upright position, said resilient means being associated with said armrests and operably connected to said guide means; and adjustment means for varying the biasing force of said resilient means.

23. A chair as defined in claim 22 including a leaf spring operably mounted to said seat and said back.

24. A chair as defined in claim 22 wherein said energy source is preloaded to provide an initial level of support before said back begins to recline.

25. A chair as defined in claim 22 wherein said resilient means includes first and second resilient means, and further includes release means for releasing said second resilient means.

26. A chair as defined by claim 25 wherein said release means is located on said armrests.

27. A chair as defined in claim 22 wherein said frame includes cross brace, and said adjustment means is mounted on said cross brace.

28. A chair as defined in claim 27 wherein said frame includes tubular members defining an interior, and said resilient means includes a strap operably connected to said back and extending through said tubular member interior to said cross brace.

29. A chair as defined in claim 22 wherein said adjustment means includes an actuator arm pivotally connected to said frame, a spring operably connected to said frame, said spring and said actuator arm defining a torque arm on said actuator arm, and said adjustment means permits varying the length of said torque arm.

30. A chair as defined in claim 29 wherein said frame includes a tubular cross brace, and said adjustment means is located in said cross brace.

31. A chair comprising:

a frame including armrests;

a seat supported on said frame;

a tiltable back movably supported on said frame and movable between upright and reclined positions; and a back-supporting mechanism including a first and a second energy source operably connected to said back and said frame for producing a biasing force on said back to support a user as the user reclines between said upright and reclined positions, and further including a selecting mechanism for selectively varying the biasing force of at least one of said energy sources.

32. A chair as defined in claim 31 wherein at least one of said energy sources and said selecting mechanism are operably connected to and located on one of said armrests.

33. A chair as defined in claim 31 including a second selecting mechanism, said first and second selecting mechanisms being attached to said first and second energy sources, respectively.

34. A chair as defined in claim 31 including a shell having sections forming said seat and back.

35. A chair a defined in claim 31 wherein said back supporting mechanism includes a leaf spring operably connected to and supporting said seat and back.

36. A chair as defined in claim 31 wherein said first and second sources each include a resilient member, and said selecting mechanism includes an engagement plate operably connected to said resilient member and one of said back and armrests, said engagement plate being movable between at least two positions to selectively change the biasing force generated by said resilient member as said back is moved rearwardly.

37. A chair as defined in claim 36 wherein said at least two positions of said engagement plate includes a release position whereat said resilient members is released so that said resilient member does not generate a biasing force on said back as said back is moved rearwardly.

38. A chair as defined in claim 31 wherein said selecting mechanism is moveable to an enabling position whereat said at least one energy source generates said biasing force on said back when being reclined, and a disabling position whereat said at least one energy source does not generate any biasing force on said back when being reclined.

* * * * *

UNITED STATES PATENT AND TRADEMARK OFFICE

CERTIFICATE OF CORRECTION

PATENT NO. : 5,308,142

DATED : May 3, 1994

INVENTOR(S) : Carl V. Forslund, III et al.

It is certified that error appears in the above-indentified patent and that said Letters Patent is hereby corrected as shown below:

Column 1, line 43:
After "styles" insert --.--.

Column 1, line 59:
"along" should be --a long--.

Column 1, line 61:
"an" should be --and--.

Column 2, line 10:
Before "invention" insert --present--.

Column 2, line 28:
"FIG. 1" should be --FIG. 13 is--.

Column 2, line 66:
"a their" should be --at their--.

Column 3, line 52:
"titled" should be --tilted--.

Column 4, line 51:
"engage" should be --engages--.

Column 5, line 68:
"respectfully" should be --respectively--.

Column 6, line 63:
"used" should be --user--.

Column 8, line 68:
"there" should be --these--.

UNITED STATES PATENT AND TRADEMARK OFFICE

CERTIFICATE OF CORRECTION

PATENT NO. : 5,308,142

DATED : May 3, 1994

INVENTOR(S) : Carl V. Forslund, III et al.

It is certified that error appears in the above-indentified patent and that said Letters Patent is hereby corrected as shown below:

Column 10, line 8, claim 13:
"an said" should be --and said--.

Column 10, line 12, claim 14:
"as axis" should be --an axis--.

Column 10, line 43, claim 21:
"a actuator" should be --an actuator--.

Column 10, line 50, claim 22:
After "tiltable" insert --back--.

Column 11, line 6, claim 27:
After "includes" insert --a--.

Column 12, line 13, claim 35:
"a defined" should be --as defined--.

Column 12, line 26, claim 37:
"members" should be --member--.

Signed and Sealed this

Thirteenth Day of December, 1994

*Attest:*

*Attesting Officer*

Bruce Lehman

BRUCE LEHMAN

*Commissioner of Patents and Trademarks*